United States Patent [19]

Moraine

[11] 4,356,913

[45] Nov. 2, 1982

[54] PACKING FOR A SHELL WITH A CASE, HAVING BETWEEN THIS LATTER AND THE FRONT PART OF THE SHELL A CURVED PART OF SMALLER DIAMETER

[76] Inventor: Gérard Moraine, 36, Rue Mortial Boudet, 92370 Chaville, France

[21] Appl. No.: 241,129

[22] Filed: Mar. 6, 1981

[30] Foreign Application Priority Data

Mar. 10, 1980 [FR] France ..... 80 05308

[51] Int. Cl.[3] ..... F42B 37/00

[52] U.S. Cl. ..... 206/3; 206/443; 206/523

[58] Field of Search ..... 206/3, 323, 446, 583, 206/592; 220/446, 447, 448, 437, 439, 408

[56] References Cited

U.S. PATENT DOCUMENTS

| | | | |
|---|---|---|---|
| 2,722,307 | 11/1955 | Burke et al. | 206/3 |
| 2,750,028 | 6/1956 | Bode et al. | 206/3 |
| 3,631,969 | 1/1972 | Lacoste | 206/3 |
| 4,004,684 | 1/1977 | Scollins | 206/3 |
| 4,159,764 | 7/1979 | Schinke | 206/3 |
| 4,234,092 | 11/1980 | Axel | 206/523 |
| 4,279,339 | 7/1981 | Gotter | 206/3 |

*Primary Examiner*—Joseph Man Fu Moy

[57] ABSTRACT

The front part of the case and the rear part of the curved part of smaller diameter, between said case and the shell properly speaking, are surrounded by two half-sheaths mating with the curve of said front part of the case and of curved part of the shell, which are held in place by fitting thereover, from the nose, a tube whose rear part is cylindrical and front part conical, this conical front part being applied against a part having the same conicity of the inner surface of the housings, when said plug of the housing is screwed on to the threaded portions at the rear of these housings.

4 Claims, 3 Drawing Figures

III
III
1
2
3
4
5
6
7
8
9
10
11
12
13
14
16
17
18
19

1
2
3
14

1
2
6
7
16
17

PACKING FOR A SHELL WITH A CASE, HAVING BETWEEN THIS LATTER AND THE FRONT PART OF THE SHELL A CURVED PART OF SMALLER DIAMETER

BACKGROUND OF THE INVENTION

The applicant company has described in one of its previous patents, French Pat. No. 75 21 538 a plastic container, for an elongated cylindrical shell, having an open end, opposite that containing the nose of the shell, and whose inner surface comprises at least one conical part whose conicity is turned towards the nose of the shell and against which a part of the shell having the same conicity bears so as to prevent any movement of the shell towards the nose.

Such a container could not be used for housing a shell having a case comprising between this latter and its front part a curved part of smaller diameter; this latter would benefit from no protection inside the container, which would present a serious danger if it were fragile, which may be the case.

SUMMARY OF THE INVENTION

The present invention provides a packing for a shell having a case comprising between this latter and the front part of the shell a curved part of smaller diameter, which is arranged so as to protect this curved part of smaller diameter. For this, this packing is formed by a container of the above-mentioned type, in combination with two molded half-sheaths, made from polyurethane for example, whose inner surface mates with the outer surfaces of the front part of the case and of the rear part of the smaller diameter curved part of the shell, and with a tube, fitted over these two half-sheaths with whose water surfaces it mates, for holding the two half-sheaths in position, the front part of said tube being conical and the middle and rear parts cylindrical or conical with a smaller conicity, and such that it may bear against a conical part of the inner surface of the container provided for this purpose which prevents any forward movement of the smaller diameter curved part of the shell, and of its case.

This container may in particular be constructed like the one described in the previous above-mentioned French Pat. No. 75 21 538 of the applicant, i.e. arranged so as to contain two similar shells and formed from two parallel housings, molded in one piece, connected together by a dividing wall common to each of them, situated in the plane passing through their longitudinal axis, and whose front part, on the nose side of the shells, is arranged so as to form a handle.

According to another characteristic of the invention and so as to facilitate stacking of the containers, each of them comprises, at its front part and at its rear part, a very strong slightly projecting belt, made from steel for example, so that, during stacking of these packages, it is the belts which rest on each other.

DESCRIPTION OF THE DRAWINGS

The accompanying drawings show by way of example one embodiment of the present invention.

DESCRIPTION OF THE PREFERRED EMBODIMENT

Figure 1:
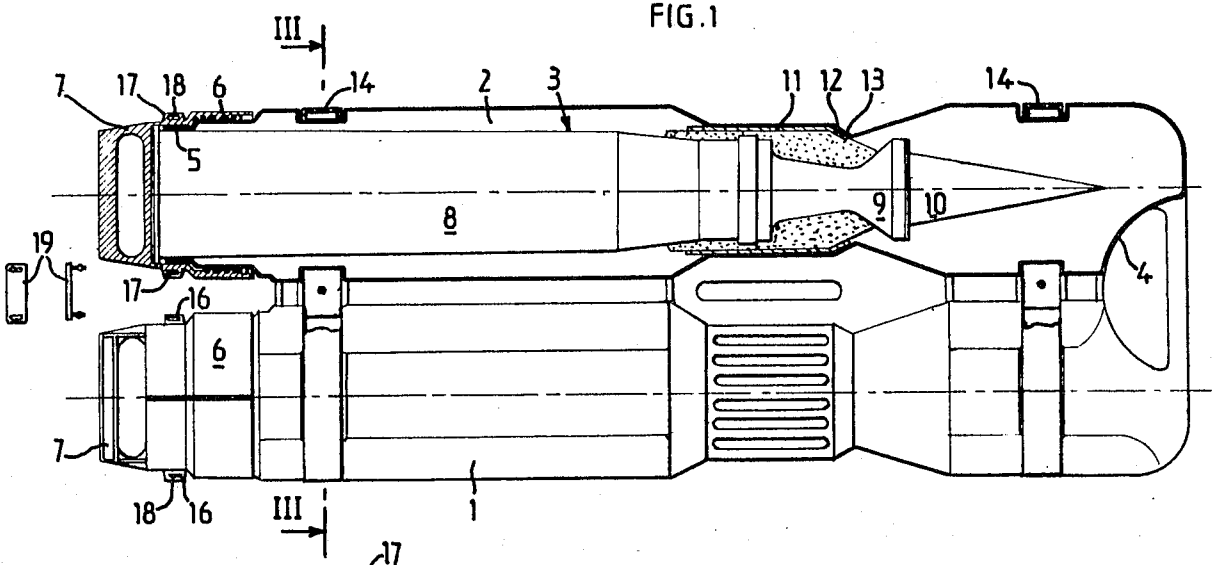
FIG. 1 is a view, partly in elevation and partly in longitudinal section, of this container.
Figure 3:
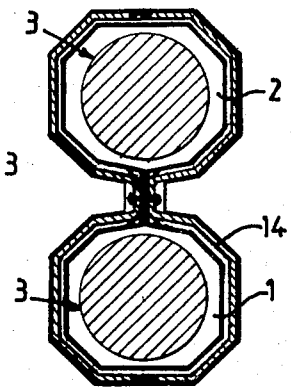
FIG. 3 is a sectional view along line III—III of FIG. 1.
Figure 2:
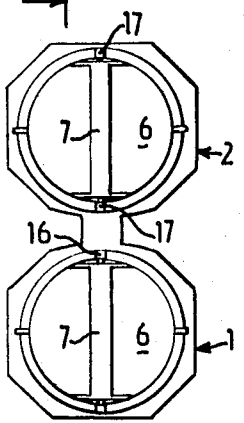
FIG. 2 is a front view of its rear part.

The container shown for two shells which may in particular be formed by molding or blowing high density, low pressure polythene, is formed from two housings 1 and 2, each intended to receive a shell 3; each of these housings is closed at its front part 4 and open at its rear part 5 which comprises an external threaded portion with square section threads on which may be screwed a plug 6 having a corresponding threaded portion. This plug is arranged so as to form a handle 7 which facilitates screwing.

Before introducing this shell into the housing of the container intended to receive it, the front part of its case 8 and the rear part of its smaller diameter curved part 9 is surrounded, between this case 8 and the shell properly speaking 10, by two half-sheaths mating with the curve of said front part of case 8 and of the curved part 9 of the shell, which are maintained in place by fitting thereover, from the nose, a tube 11 whose rear part is cylindrical and front part 12 conical, this front conical part 12 being applied against a part 13, having the same conicity, of the inner surface of housings 2, when plug 6 of the housing is screwed on to the threaded portions at the rear of these housings. At the front part and at the rear part of this container there are provided slightly projecting belts 14, made from steel or from a plastic material of the same strength, which may be the only parts of the containers in contact with each other during stacking thereof.

These belts may be formed from hinged elements having a flat bottom and a section in the shape of a U, whose legs are turned outwards, and comprising therefore flat external bearing surfaces, with longitudinal notching.

The plugs 6 may be provided with flanges 16 and 17 having a window 18 therein, so that unscrewing of these plugs may be prevented by means of a locking part 19 having two lugs engageable, one in the window 18 of one of the flanges 16 of one of plugs 6, and the other in the window of another of the flanges 17 of the other plug.

It should of course be understood that the embodiment of the invention which has been described above with reference to the accompanying drawings has been given purely by way of indication and is in no wise limiting and that numerous modifications may be made without for all that departing from the scope and spirit of the invention.

What is claimed is:

1. A packing for a shell having a case and between the case and the front part of the shell a curved part of smaller diameter, said packing comprising a container made from plastic material having an open end opposite that of the front part of the shell, said open end being adapted to be closed by means of a sealing lid, said container having an inner surface comprising at least one conical part having a conicity directed towards the front part of the shell for limiting the amount the shell is driven into the container when the rear part of the shell is urged forwards by closing of the lid, two molded half-sheaths made from polyureathane, for example, having inner surfaces mating with the outer surfaces of the front of the case and of the rear part of the curved part of smaller diameter of the shell, and a tube fitted over said two half-sheaths and mating with the outer surfaces of said half-sheaths to maintain the half-sheaths in position, said tube having a front part which is conical and middle and rear parts which are cylindrical or conical with a lesser conicity, so that said tube's conical front part bears against said conical part of the inner surface of the container when closing of the lid pushes the rear of the case of the shell forward, said two half-sheaths assuming the exact shape of the outer surfaces of the front part of the case and of the rear part of the curved part of smaller diameter of the shell and the tube which surrounds them.

2. The packing as claimed in claim 1, wherein said container is arranged so as to contain two similar shells and formed from two parallel housings, molded in one piece, connected together by a dividing wall common to each of them and situated in a plane passing through their longitudinal axes, the front part of said container, at the front part of the shells, being arranged so as to form a handle.

3. The packing as claimed in any one of claims 1 or 2, wherein, so as to facilitate stacking of the container with other such containers, it comprises, at its front part and its rear part, a very strong slightly projecting belt made from steel, for example, so that, during stacking of the containers, it is the belts which rest on each other.

4. The packing as claimed in claim 2, wherein the rear part of each of the housings is closed off by a screw plug comprising said sealing lid, said plugs being provided with flanges having a window therein, and a locking piece comprising lugs each engageable in the window of one of the plugs for locking same.

* * * * *